US006896349B2

(12) United States Patent
Valero et al.

(10) Patent No.: US 6,896,349 B2
(45) Date of Patent: May 24, 2005

(54) PRINTER DEVICE AND METHOD

(75) Inventors: Jose Luis Valero, Barcelona (ES); Martin Urrutia, Barcelona (ES); Corrina Hall, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/353,850

(22) Filed: Jan. 28, 2003

(65) Prior Publication Data

US 2003/0174186 A1 Sep. 18, 2003

(30) Foreign Application Priority Data

Jan. 31, 2002 (EP) ..... 02002312

(51) Int. Cl.[7] ..... B41J 2/165
(52) U.S. Cl. ..... 347/22
(58) Field of Search ..... 347/22–35, 115, 347/119, 156; 399/309, 320; 309/401; 355/50; 358/496; 101/211, 486

(56) References Cited

U.S. PATENT DOCUMENTS 5,659,342 A * 8/1997 Lund et al. ..... 347/35
6,570,599 B2 * 5/2003 Jacob et al. ..... 347/156

FOREIGN PATENT DOCUMENTS

DE 100 16 203 A1 10/2001
EP 0 316 198 B1 10/1994

OTHER PUBLICATIONS

Webster's II New College Dictionary.*

* cited by examiner

*Primary Examiner*—Shih-Wen Hsieh

(57) ABSTRACT

A printer apparatus comprising one or more printing elements arranged to print on print media located in a print position, the apparatus further comprising first and second media paths respectively adapted to feed media to and away from the print position, the apparatus being arranged to selectively divert a print media sheet from the second media path to the print position, the apparatus being arranged to implement a servicing routine comprising marking the diverted sheet with one or more of the printing elements.

35 Claims, 4 Drawing Sheets

PRINTER DEVICE AND METHOD

FIELD OF THE INVENTION

The present invention relates to printer devices, and particularly, although not exclusively, to a method and apparatus for servicing printing nozzles in page wide array ink jet devices.

BACKGROUND TO THE INVENTION

As is well known in the art, conventional inkjet printers generally employ one or more inkjet cartridges, often called "pens", which shoot drops of ink onto a page or sheet of print media. For instance, two earlier thermal ink ejection mechanisms are shown in U.S. Pat. Nos. 5,278,584 and 4,683,481, both assigned to the present assignee, Hewlett-Packard Company. The pens are usually mounted on a carriage, which is arranged to scan across a scan axis relative to a sheet of print media as the pens print a series of individual drops of ink on the print media. The series of drops collectively form a band or "swath" of an image, such as a picture, chart or text. Between scans, the print medium is advanced relative to the scan axis. In this manner, an image may be incrementally printed.

A continuing goal of inkjet printing technology is to increase the speed (i.e. reduce the time) with which an image may be printed. Various factors limit the speed with which an image may be printed. Amongst these factors is the time that the printhead carriage requires to scan across the print media. This time is especially important in unidirectional print modes, which are usually used to achieve high print quality. In unidirectional print modes, ink is printed only whilst the carriage is moving in one direction along the scan axis. Thus, for every printed swath, a non-printing return movement of the carriage along the scan axis is required.

One known method of avoiding this limitation is to use a page wide array (PWA) of printheads. In PWA printers, an array of printheads extending across the width of the page is used. Thus, ink may be ejected across the entire printable width of the print media, without moving the printheads across the width of the page. Generally, the print medium is then fed in a direction perpendicular to the array of printheads while the array of printheads is maintained stationary. In this manner, such scanning times may be eliminated.

In order to maintain the quality of the printed output of the printer device, it is important that each instruction to the print head to produce an ink drop from a given nozzle does indeed produce such an ink drop. Thus, it is important to verify that each nozzle is functioning correctly.

In order to achieve this, it is common practice in ink jet devices, to periodically initiate a "spitting" routine, whereby a nozzle may be purged by sending it a sequence of fire pulses, possibly of greater energy than the normal firing pulse. This serves to ensure that the ink contained in the nozzles does not dry, causing a blockage of dry ink, which stops the nozzle from firing correctly. Spitting routines also help to clear already blocked, or partially blocked nozzles, which may be caused by paper fibers or dried ink, for example.

Such techniques are used in many conventional inkjet printers, such as the Hewlett-Packard DesignJet 1050 and Hewlett-Packard DesignJet 5000. However, as is conventional in such systems, in order to carry out each spitting routine, the printheads are moved to a service station located away from the print zone of the printer, where the nozzles may spit into a spittoon which is designed to receive and store the ink expelled during the spitting procedure. After the spitting procedure is complete, the printheads are returned to the print zone where they may then continue to print. This process is time consuming and throughout the whole process, the printer is unable to print. Therefore, such techniques are not well suited to PWA systems. This is because, a PWA system may have a very high number of nozzles, tens of thousands for example, that very frequent spitting routines are required. Furthermore, since they aim to provide increased throughput, relative to conventional scanning inkjet printers, they are less tolerant to printing downtime.

It would therefore be desirable to provide an improved system and method for servicing ink jet devices.

SUMMARY OF THE INVENTION

According to the present invention there is provided a printer apparatus comprising one or more printing elements arranged to print on print media located in a print position, the apparatus further comprising first and second media paths respectively adapted to feed media to and away from the print position, the apparatus being arranged to selectively divert a print media sheet from the second media path to the print position, the apparatus being arranged to implement a servicing routine comprising marking the diverted sheet with one or more of the printing elements.

In this manner, a printer device according to the present invention may implement a spitting operation without moving the print head(s) or printing elements away from the media path. Thus, allowing such routines to be performed more quickly, and so in a manner that has a reduced impact on the throughput of the printer.

Additionally, by allowing sheets of print media, upon which spitting routines are implemented, to be diverted back to the print zone for reuse, the cost of spitting or other such servicing routines may be reduced in terms of the cost in consumables.

Preferably, the printer is arranged to return media sheets used in servicing routines via a third media transport path. In this manner, the normal media paths, for transporting normal print media for printing print jobs to and from the print zone of the printer, are not obstructed by the presence of the media sheets used in servicing routines. In this manner, the printer may continue to print a given print job in between spitting or other such servicing operations.

Preferably, the third media path is arranged to hold the media sheets used in servicing routines in an offline position until they are reintroduced into the print zone of the printer in order to carry out a further servicing routine.

In one preferred embodiment, the printer comprises a continuous belt feed mechanism which transports sheets through the print zone and then onwards. Thus, in certain embodiments, the second media path may be a continuation or an extension of the first media path. If the media path or paths in certain embodiments comprises a continuous belt feed mechanism, mechanical devices, electrostatic attraction or a vacuum force or the like may be used in order to secure a sheet during transport.

Preferably, the printer is adapted to use different types of media for servicing routines and for printing print jobs required by the user. By using less expensive print media for serving operations, the cost of the servicing routines in terms of the consumables used may be further reduced. Preferably, the printer has two or more media input trays, one holding media for the servicing routines and one for print jobs.

Preferably, the printer is an ink jet printer with a page wide array of print elements.

The present invention also extends the corresponding method and to a printing system comprising a printer according to the present invention. Furthermore, the present invention also extends to a computer program arranged to implement the present invention in conjunction with suitable hardware.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described by way of example only the best mode contemplated by the inventors for carrying out the invention.

System of the Present Embodiment

Figure 1:
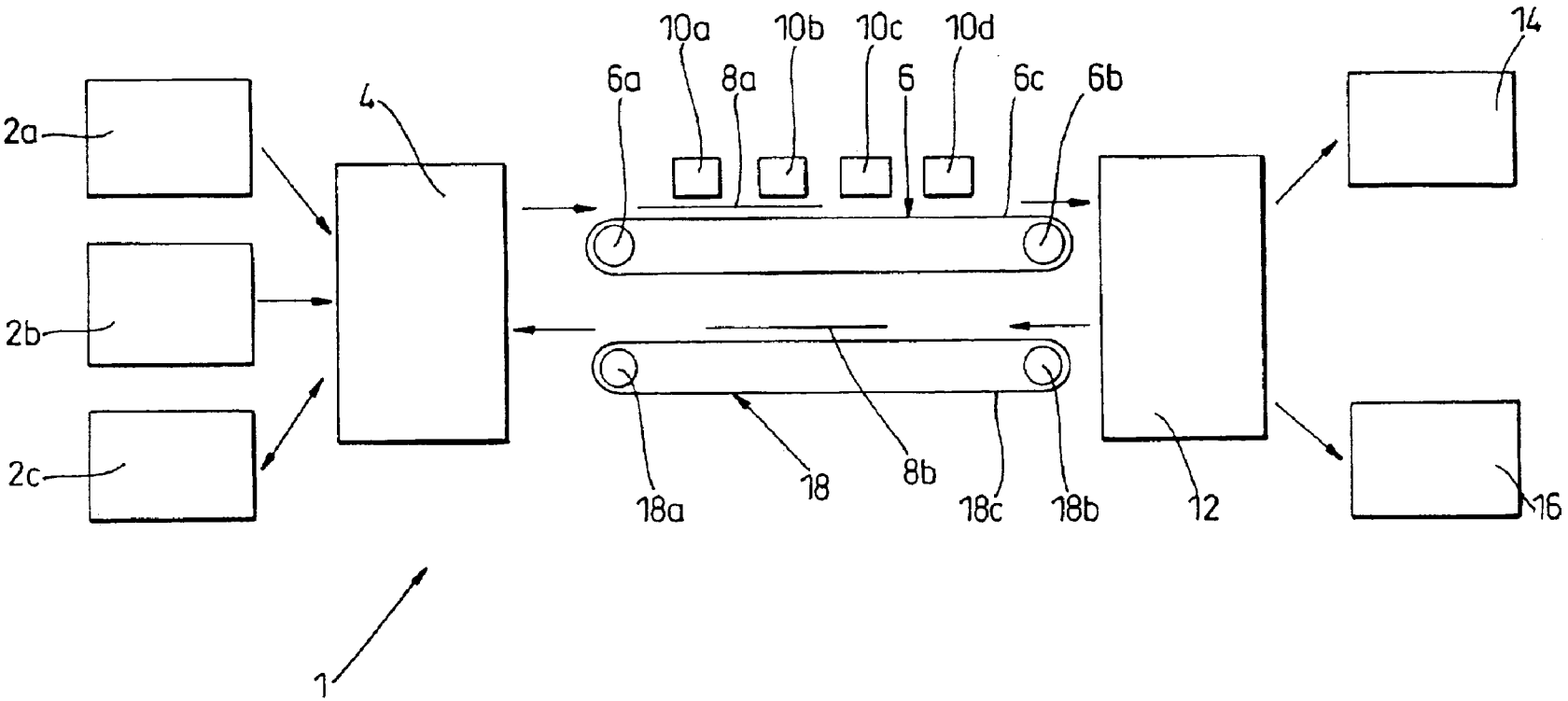
FIG. 1 illustrates schematically a printing device according to an embodiment of the present invention.

Referring to FIG. 1, a PWA printer device 1 according to the present embodiment is schematically illustrated.

The printer 1 has three input trays 2*a*, 2*b* and 2*c*. The input tray 2*a* is used to store conventional sheets of print media upon which pages of a print job may be printed. Usually such sheets are stored in the tray in the form of a stack. The tray may be opened and the print media replenished by the user when additional print media is required. The input tray 2*b* is used to store sheets of a print medium, upon which the printer may carry out spitting operations; hereafter termed "spitting sheets". In the present operation, the spitting sheets are conventional printing paper. However, preferably, they are of lower quality and is thus cheaper than the print media used for print jobs. Again, it may be stored in the input tray 2*b* in the form of a stack and replenished when required by the user. As will be described in more detail below, the third input tray 2*c* provides temporary storage for one or more spitting sheets that have been partly used for spitting operations and are awaiting further use. The input tray 2*c* may take the form of a conventional tray, or a sheet escrow, for example, as is well understood in the art of printers and photocopiers.

In the present embodiment, preferably the dimensions of the spitting sheets need not be fixed. Thus, spitting sheets of any suitable size may be used, once the dimensions have been entered into the printer operating system, in a conventional manner.

Adjacent to the input trays 2*a–c* is located a media handling device 4. The media handling device is arranged to pick a sheet from any of the input trays 2*a–c*, when this is required, and to pass the picked sheet to a print media forward transport path 6. As will be described in more detail below, the media handling device is also arranged to return spitting sheets that have been partly used in spitting operations from a return transport path 18 to the third input tray 2*c*, to await further use.

In the present embodiment, the input trays and the media handling device may be conventional in the field of printers and photocopiers. Such devices are well understood by those skilled in the art. Therefore, they will not be described further.

In the figure, the forward transport path 6 is schematically illustrated as a continuous belt 6*c* supported at either end on rollers 6*a* and 6*b*. However, the skilled reader will realize that may suitable sheet transportation mechanism or technique may instead be used. The sheet, which may be either a spitting sheet or a sheet of print media for a print job, is located on the upper surface of the continuous belt by the media handling device. In the figure, this sheet is referenced 8*a*. One or both of the rollers 6*a*, 6*b* are driven by an electric motor (not shown) in order to transport the media sheet in the direction of the arrows, towards a duplex sheet handling device 12.

The skilled reader will appreciate that various known techniques are used in order to ensure accurate transportation of the sheet. Such techniques are well know and understood in the art of printing, thus they will not be further descried here. However, amongst others, they include the use of opposing rollers, electrostatic attraction, vacuum force, or other mechanical devices in order to avoid the media sheet from slipping relative to the transport mechanism.

As the media sheet is transported along the forward transport path in the direction of the arrows, it passes under four stationary print bars 10*a–d*. As is understood in the art, a print bar is an array of ink jet nozzles that is arranged to extend across the width of the print media that is to be printed on; i.e. substantially perpendicularly to the direction of transport of the print media. This array of ink jet nozzles may indeed be composed of a number of suitably arranged conventional ink jet print cartridges, or "pens". Thus, ink may be deposited across the entire printable width of the print media, without moving the printheads across the width of the print media. Print bars are known and well understood in the art and so they will not be described further. However, the reader is referred to European Patent 0 677 388 B1, in the name of Hewlett-Packard Co., which describes the structure of print head bars for use in a PWA printing system, together with the associated print head data and control circuitry. European Patent 0 677 388 B1 is hereby incorporated by reference in its entirety.

One of the print bars, for example the print bar 10*a*, may be configured to eject black ink onto the recording medium. The print bars 10*b–d* may be configured to eject variously coloured inks, e.g., yellow, magenta and cyan inks, respectively. In the present invention, the print bars 10*a–d* each print dye-based inks, however, other inks, such as pigment-based inks may instead be used. Therefore, as the sheet passes under the nozzles of the four print bars, a given portion of the sheet may received ink ejected from each of the print bars 10*a*, 10*b*, 10*c* and 10*d* in that order. Thus, in the case of a colour image, it is incrementally built up, colour by colour. Connected to each of the print bars is a conventional ink delivery system (not shown), which delivers the correct coloured ink from a reservoir via a system of ink delivery tubes to the nozzles associated with the print bar.

Once the sheet has passed by each of the four print bars, it is transferred from the transport path to a conventional duplex sheet handling device 12. In the present embodiment, the duplex device may direct a sheet in one of two forward directions. The first of these transfers the sheet to a conventional output tray 14. The output tray 14 is used to store finished pages of a print job printed by the printer, until they are collected by the user. The second of these directions transfers the sheet to a further conventional output tray 16. The output tray 16 is used to store waste spitting sheets, after they have been used in spitting operations, until they are collected for disposal by the user. Finally, the duplexing device may direct spitting sheets used in spitting operations in a third direction, along the return transport path 18. In FIG. 1, a spitting sheet, referenced 8*b*, is shown being supported on the return transport path 18. In the figure, the return transport path 18 is illustrated schematically as a single continuous belt 18*c* supported at either end on rollers 18*a* and 18*b*. However, in practice, any suitable transport path may be used, again using conventional sheet handling technology. For example: two opposing belts; two series of opposing belts; or opposing rollers etc.

The return transport path 18 transports the spitting sheet 8*b* to the media handling device 4, which in turn transfers the spitting sheet to the third input tray 2*c*, to await further use.

In a simple embodiment of the invention, the skilled reader will understand that the function of the temporary storage tray, may be performed by the return transport path 18. However, if the return transport path is to be used in other functions, it is preferable that a separate temporary storage tray be used to hold spitting sheets prior to reuse. An example of a further function which may be performed by the return transport path is in duplex printing, where it may be used to transport a sheet, already printed on one side by the printer, back to the print zone for printing on the reverse side.

Figure 2:
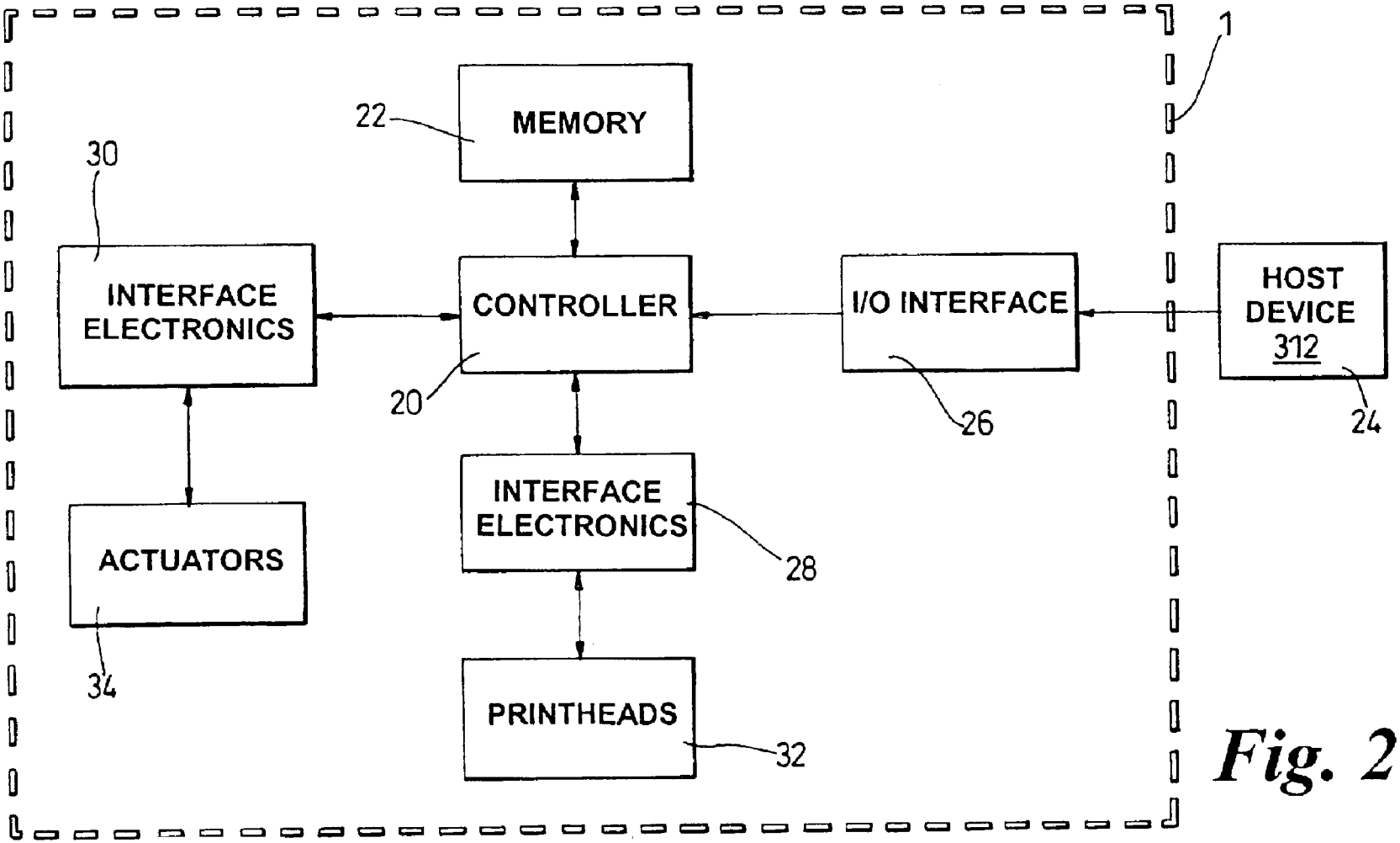
FIG. 2 is a schematic diagram illustrating subsystems of the printing device of FIG. 1.

The functions of the printer 1 of the present embodiment are controlled by a controller 20. FIG. 2 schematically illustrates the printer 1 and the controller, together with the systems and subsystems that are most relevant to this description, with which it interacts.

The controller is arranged to read software code from a memory 22, that when executed by the controller, controls the functionality of the printer. The controller may be implemented using any suitable technology; for example: a microprocessor; a micro-controller; an application specific integrated circuit (ASIC), and the like.

The controller is arranged to communicate with an external host device 24, such as a computer, server, workstation or the like, via an input/output interface 26. In this manner, the controller may receive print instructions and data transmitted from the host device and may send return messages to the host device in a conventional manner. The I/O interface may conform to any suitable known protocol such as RS-232, parallel, small computer system interface, universal serial bus, etc.

The memory 22 may also be configured to provide a temporary storage area for data, such as print data, received by the printer from the host device, or indeed any data generated by systems of the printer. Preferably, therefore, the memory may be implemented as a combination of volatile and non-volatile memory, such as dynamic random access memory ("RAM"), as is well understood in the art.

The printer may also include conventional interface electronics 28 and 30, configured, respectively, to provide an interface between the controller and the printheads 32 of each print bar, and between the controller and actuators 34 associated with the elements of the sheet transport paths; such as the duplex sheet handling device 12, media handling device 4 and the forward and reverse print paths 6 and 18, respectively.

Method of the Present Embodiment

Figure 3:
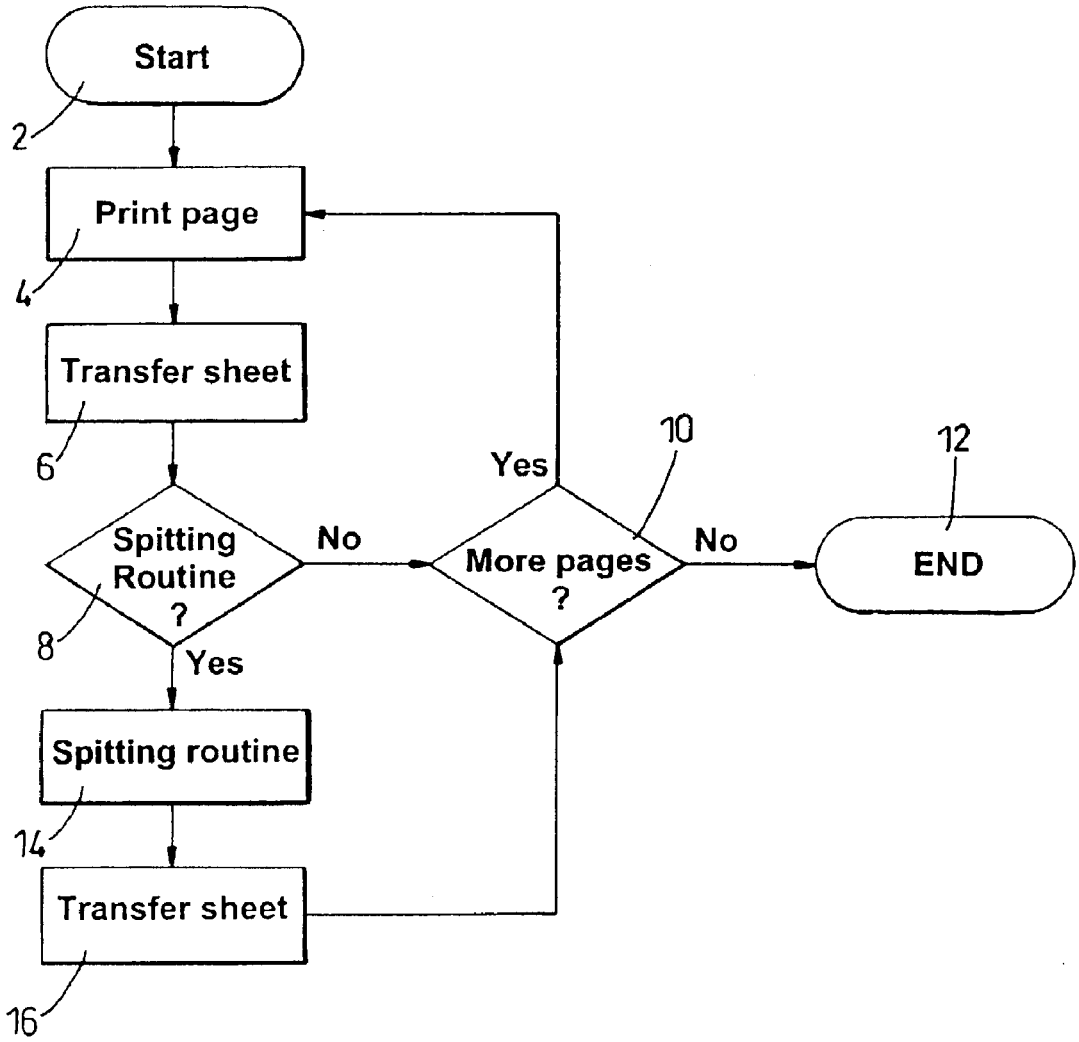
FIG. 3 is a flow diagram illustrating the method of an embodiment of the present invention; and, FIGS. 4*a–d* illustrate a sheet of print media as it is repetitively used in spitting operations, according to an embodiment of the present invention.

The method of the present embodiment will now be described with reference to the flow diagram illustrated in FIG. 3.

At step 2 indicated in the figure, a printing operation is initiated by a user in a conventional manner. This causes the printer to carry out any data processing and preliminary configuration operations that may be required prior to commencing printing, as are customary in the art. Subsequently, at step 4, the printer prints the first page of the print job. This is initiated by the paper handling device 4 picking a sheet of print media from the input tray 2*a* and transferring it to the forward transport path 6, where it receives ink from the print bars, as described above. Once the printing of the current page has been completed, it is transferred to the output tray 14, at step 6, by the duplex sheet handling device 12.

Subsequently, at step 8, the controller determines whether it is required that any of the nozzles in the print bars carry out a spitting routine. Any conventional method may be used to select those nozzles which are due for a spitting routine. Such methods are well understood by the skilled reader, therefore, they will not be described in detail here. However, for example, each nozzle in a given print bar may be subjected to a spitting routine after a certain number of pages have been printed, or after a certain length of time has elapsed since the previous spitting routine was implemented. Alternatively, the use of each individually nozzle may be recorded by the controller. In this manner each nozzle may fall due for a spitting routine after a certain number of uses (i.e. drops ejected), or a certain period of inactivity, or indeed a function of these two criteria. Furthermore, the servicing history of the element, recorded by the controller may be used to modify the time by which a nozzle falls due for a spitting routine.

If no nozzles are selected for a spitting routine at that moment, the controller determines at step 10 whether there are remaining pages of the print job to be printed. In the event that there are remaining pages of the print job to be printed, the process continues at step 4, where the next page of the print job to be printed is printed. This process (steps 4, 6, 8 and 10) continues until the controller determines either that a spitting routine should be implemented at step 8, or that no more pages of the print job remain to be printed, at step 10. In the latter case, the process ends at step 12. However, in the former case, a spitting routine is initiated, at step 14, for selected nozzles in the following manner.

The controller firstly determines whether there is a spitting sheet present in the temporary input tray 2*c*. If there is a spitting sheet present in this tray, the controller controls the media handling device 4 to pick that spitting sheet. However, if the temporary input tray 2*c* is empty, the media handling device 4 is controlled to pick a new spitting sheet from the input tray 2*b*. In either case, the picked sheet is transferred to the forward media path 6. In this example, it is assumed that the temporary input tray 2*c* is currently empty and thus a clean spitting sheet is picked from the input tray 2*b*.

When the picked spitting sheet arrives at the print zone of the printer, beneath the print bars, the controller controls the nozzles selected to undergo the spitting routine to each implement a spitting routine, as is well understood in the art. The degree of spitting, that is the power of each firing pulse, together with the frequency and number of the pulses, that is required will depend upon the characteristics of the printer system as well as the aims of the spitting routine. Therefore, this may be determined by experimentation.

Figure 4D:
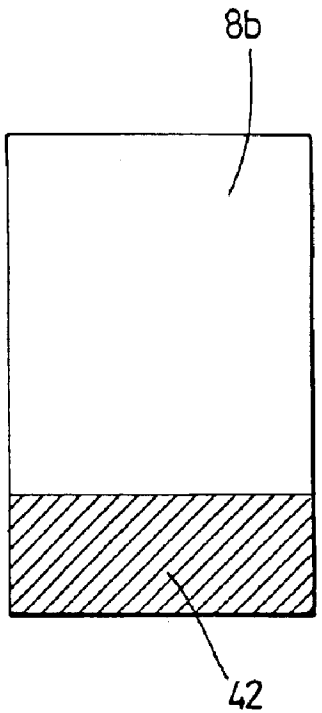
Figure 4C:
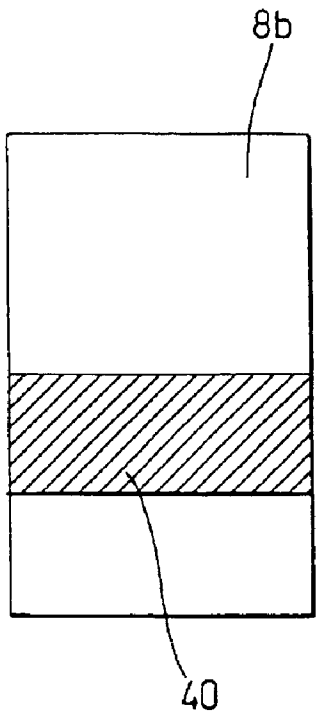
Figure 4B:
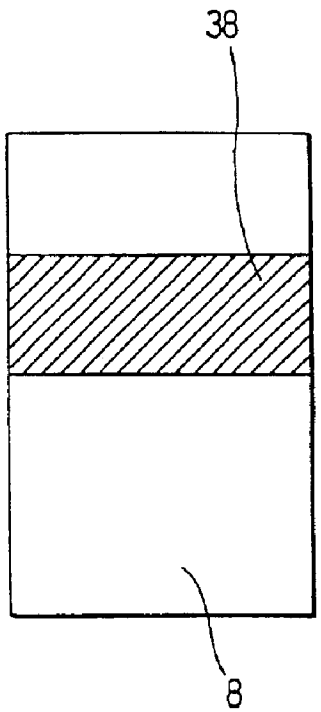
Figure 4A:
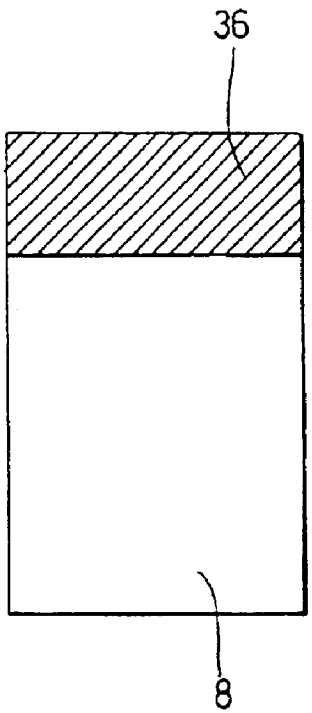

In the present embodiment, the controller times the spitting operation of each the selected nozzles such that the ink drops ejected in the spitting operation are printed on a selected area 36 of the spitting sheet 8*b*; in this example this is a band adjacent to the leading edge of the spitting sheet as it passes under the print bars, as is illustrated schematically in FIG. 4*a*. In this manner, the ink drops that are ejected from the selected nozzles during the spitting routine are all printed on the spitting sheet. Thus, this ink does not dirty the mechanism of the printer. Furthermore, the printer does not require any specialised structure, such as a spittoon, for collecting the ink ejected during spitting operations.

Once the spitting operation has been completed and the spitting sheet passes to the end of the forward transport path 6, it is transferred along the return transport path 18, at step 16, by the duplex sheet handling device 12. It then is carried to the media handling device 4, from where it is directed to the temporary storage input tray 2*c*. The spitting sheet is then held in the temporary storage input tray 2*c* until a further spitting routine is required.

The controller may then continue with the printing process, by determining whether further pages of the print job remain to be printed, at step 10. If no more pages of the print job remain to be printed, the controller may terminate the printing process at step 12. However, if further pages to be printed, the controller causes the next of these pages to be printed at step 4, as was described above with respect to step 4 of the method. In practice, the sheets being transported by the forward media path 6 may well be arranged in an end to end manner, in order to keep the throughput high. Therefore, as soon as the spitting sheet 8*b*, upon which the spitting routine was carried out, starts to vacate the print zone, the next page of the print job may be printed on a following, adjacent sheet.

In contrast to prior art methods, the available printing time is not reduced by having to move the printheads away from the print zone to a service station, for example, where a spitting routine may be implemented. Thus, the spitting process according to the present embodiment may cause the throughput of the printer to be reduced only by the time that it takes the forward transport path 6 to move the length of the spitting sheet used in the spitting operation. Thus, the skilled reader will understand that the dimensions of the spitting sheet used may be chosen with this in mind. In this manner, the effect of the spitting routines on the throughput of the printer may be minimised, for a given forward transport path speed, by using spitting sheets having the minimum length required to carry out the require spitting routines. The effect of the spitting routines on the throughput of the printer may be further reduced by temporarily increasing the forward transport path speed when transporting spitting sheets. However, in some cases such a change in the equilibrium of the printer may have an undesirable effect on subsequent print quality. Thus, the exact dimensions of the spitting sheet and the speed(s) of the forward transport path may be determined experimentally for a given printer set up.

As has been stated above, if further pages of the print job remain to be printed, it then proceeds as described with reference to steps 4, 6, 8 and 10 until it is completed, or until the controller determines that a further spitting routine should be implemented at step 8.

In the event the controller determines that a further spitting routine should be implemented at step 8, it is implemented in substantially the same manner as has previously described with reference to step 14 above. However, in this case, the media handling device 4 picks the partially used spitting sheet that is being held in the temporary input tray 2*c*. Additionally, in order to avoid saturating the spitting sheet with ink from different spitting routines, the controller times the spitting operation of each the selected nozzles such that the ink drops ejected in the spitting operation are printed on a selected area 38 different from that 36 used for the previous spitting routine. In the present example, the new selected area 38 is a band running across the spitting sheet 8*b*, adjacent and parallel to the band 36 used in the previous spitting operation. The area 38 is schematically illustrated in FIG. 4*b*. At the end of this spitting routine, the sheet 20 is again returned to the temporary input tray 2*c* in the same manner as is described above.

In the same manner, subsequent spitting operations may be carried out using the same spitting sheet 8*b*. However, again in order to avoid saturating the sheet, different areas 40 and 42 of the spitting sheet are used, as are illustrated in FIGS. 4*c* and 4*d*, respectively, until one surface of the spitting sheet has been substantially covered in ink from various spitting routines. Once this stage is reached, the spitting sheet is directed to the output tray 16 used to store waste spitting sheets. In this manner, in the present embodiment, each spitting sheet used in spitting routines is efficiently used, only being disposed of when substantially its entire area is saturated. The next spitting routine may then commence once again with a new spitting sheet.

Thus, in the example illustrated in FIG. 4, four separate spitting routines are implemented using the one sheet. However, this number may be more or less than this depending on various factors; such as the amount of ink ejected during each spitting routine, the ink absorbency of the spitting sheet, the size of the spitting sheet etc.

In the example of the present embodiment, for ease of explanation, the determination made by the controller at step 8, as to whether any of the nozzles require a spitting routine, is illustrated as being made subsequent to the printing of a page at step 4. However, in practice, this determination may be made by the controller during or even well before the printing of the page at step 4. One reason for this is that a PWA system may have a forward media path 6 that is very long in relation to the sheets of print media that it transports. Thus, during normal operation it may, at any given moment, be transporting a number of sheets, arranged end to end, towards the print bars. Therefore, if a spitting sheet is to be located under a given print bar at a required time, the controller must cause that spitting sheet to be picked, having already determined that a spitting routine will be required, sufficiently in advance of the required time to allow this to happen. The skilled reader will appreciate that this may also apply to other steps in the described method, such as the determination may be the controller as to whether further pages of the print job remain to be printed, at step 10.

The skilled reader will appreciate that each of the spitting operation described in the present embodiment may be performed during a single print job, or alternatively, each spitting operation may be performed during different print jobs.

Further Embodiments

In the embodiment described above, numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, although the above embodiment is described with reference to a PWA printing system, the skilled reader will appreciate that the present invention may be used to advantage in other types of printer devices, such as conventional type scanning ink jet devices.

It will also be appreciated that in other embodiments of the invention, various changes may be made to the spitting sheets and the way in which they are used. For example, although in the above described embodiment spitting on only one side of the spitting sheet was described, the skilled reader will appreciate, that the media handling device may be arranged to turn the spitting sheet over so that spitting operations may additionally be carried out on the reverse side. Additionally, materials other than paper may be used for the spitting sheet; for example, acetate sheets. The preferred choice of material will generally be based on cost. In the case of acetate sheets, it may be possible to economically clean off and/or to dry the ink deposited on them during spitting routines, such that they may be reused many times. Such a cleaning process may be implemented inside the printer device, or manually outside of the printer. Furthermore, the structure of the printer may be simplified by using the print media, upon which the print job is printed, as spitting sheets. In this manner, the requirement for a specific input tray for spitting sheets may be avoided.

Furthermore, although in the above described embodiment, the method commenced with the printing of a page of the print job, the skilled reader will appreciate that in other embodiments of the invention, the first printing operation performed may be a spitting routine, with print job being started after the spitting routine has been finished.

It will also be appreciated that whilst in the above embodiment the described method does not transport more than one spitting sheet consecutively through the print zone, this need not necessarily be the case. In one embodiment of the invention, the controller may transport two or more, or even many spitting sheets consecutively though the print zone. This may allow major servicing operations to be effectively carried out, as may be periodically required.

In a further embodiment, where the printer has an inbuilt drop detection system, the ability to transport more than one spitting sheet consecutively through the print zone may be particularly useful, since it allows the printer to continue a spitting operation repetitively until the performance of a given nozzle, or nozzles, is determined by the drop detection system to be satisfactory.

In one such embodiment, the printer incorporates an optical scanner arranged to scan drops printed on a spitting sheet by one or more nozzles during a spitting routine, or drop testing routine. Such a scanner may be located between the media handling device 4 and the temporary input tray 2*c*. In this embodiment, the scanner may be any conventional image capturing device. Preferably, however, a conventional CCD scanning element, such as is conventional in photocopying devices is used. The manner in which such a scanner may operate to detect pixels of an image is described in U.S. Pat. No. 6,037,584, assigned to Hewlett-Packard Co, which is hereby incorporated by reference in its entirety. This type of scanner has the advantage of being commercially available with a relatively wide field of view. This allows the scanning of a spitting sheet to be performed rapidly, in a single pass of the scanning device relative to the spitting sheet. It also makes it possible to mount the scanner stationary in the printer device relative to the media transport path, thus giving rise to a simpler and more robust scanner implementation.

When the drops ejected onto a spitting sheet during a spitting routine (or drop testing routine) have been scanned, the scanned image is converted into electronic data, by electronics associated with the scanner in a conventional manner. As will be understood by the skilled reader, the electronic data is indicative of the dots or marks (made up of a number of dots), produced by one or more nozzles on the spitting sheet during the spitting or drop testing routine. This data may then be transmitted to the controller, which may, in a conventional manner, compare the scanned position, shape and size of the dots or marks produced by a given nozzle with the intended position, shape and size of the dots or marks. Any detected deviation between the scanned and intended position, size and shape of the dots or marks printed by a given nozzle may be used to diagnose a problem with the nozzle concerned, in a conventional manner known to the skilled person in the field. Amongst others, these include drop placement errors, nozzle-outs, clogs and abnormal ink drop volumes.

In the event that a problem is detected with a given nozzle, a spitting routine may be carried out or repeated, as described above. As has been described above, this process may be continued until the nozzle in question is found to be functioning correctly one again. However, in the event that the nozzle is still not functioning correctly after a given number of spitting routines, the controller may instigate any other suitable type of remedial action; for example "error hiding". In cases where there is a nozzle redundancy built into the printer, those nozzles have been identified as not functioning correctly may be deselected and so not used in a subsequent printing operation. Thus, the print mode, which is used to print the image, may be re-designed, preferably in real time, to avoid printing with those particular nozzles. Thus, the workload that would normally be undertaken by those nozzles is reassigned to other, or replacement nozzles. Examples of error hiding techniques which may be adapted for use in combination with the present invention are disclosed in European Patent Applications 99103283.0 and 98301559.5, both in the name of Hewlett-Packard Co, which are hereby incorporated by reference in their entirety.

In another embodiment, the printer apparatus comprises one or more printing elements arranged to print on print media located in a print position, the apparatus further comprising first and second media paths respectively adapted to feed media to and away from the print position, the apparatus being arranged to selectively divert a print media sheet from the second media path to the print position, the apparatus being arranged to implement a servicing routine comprising marking the diverted sheet with one or more of the printing elements; a sheet diverter arranged to divert the diverted sheet from the second media path to a third media path, the third media path being arranged to feed the diverted sheet either directly to the print position or indirectly, via the first media path; the printer arranged to carry out a two or more servicing routines on a selected sheet, and further arranged to transport the selected sheet along the third media path between successive servicing routines.

From the above, the skilled reader will appreciate that the present invention may be used in order to reutilize print media for a broad range of purposes, other than spitting and drop detection. For example, printhead alignment patterns and other patterns, as are well understood in the art, which allow the physical set up of a printer device to be verified or checked, may be printed on reused sheets in the manner described in the above embodiments. Other applications for the present invention may include the printing of test sheets, colour calibration and gray scale test prints amongst others.

What is claimed is:

1. A printer apparatus comprising one or more printing elements arranged to print on print media located in a print position, the apparatus further comprising first and second media paths respectively adapted to feed media to and away from the print position, the apparatus being arranged to selectively divert a print media sheet from the second media path to the print position via the first media path, the apparatus being arranged to implement a servicing routine comprising marking the diverted sheet with one or more of the printing elements.

2. A printer according to claim 1, further comprising a picking device arranged to pick a cut sheet of print media from a media supply and to pass the picked sheet to the first media path, the printer being arranged to implement a servicing routine on the sheet before the sheet reaches the second media path.

3. A printer according to claim 2, comprising one or more picking devices arranged to pick cut sheets of print media from a first and a second media supply, the printer being adapted to select a sheet from the first supply for printing a print job and to select a sheet from the second supply for implementing a servicing routine.

4. A printer according to claim 1, further comprising a sheet diverter arranged to divert the diverted sheet from the second media path to a third media path, the third media path being arranged to feed the diverted sheet either directly to the print position or indirectly, via the first media path.

5. A printer according to claim 4, arranged to carry out a two or more servicing routines on a selected sheet, and further arranged to transport the selected sheet along the third media path between successive servicing routines.

6. A printer according to claim 1, further comprising a first and a second output position, and being arranged to output print jobs to the first position and to output sheets marked in servicing routines to the second position.

7. A printer according to claim 1, further comprising a scanner device, such as a charge coupled device (CCD), arranged to scan the marks made on a sheet upon which a servicing routine is performed.

8. A printer according to claim 1, wherein the printer is an inkjet printer.

9. A printer according to claim 8, wherein the servicing routine comprises a spitting operation or the printing of a drop detection pattern or a colour calibration pattern.

10. A printer according to claim 1, wherein the one or more printing elements form at least part of a page wide array.

11. An inkjet apparatus being arranged to carry out servicing operations at selected intervals, the servicing operations comprising controlling selected inkjet nozzles to eject ink onto a sheet of print medium located at a print position, the apparatus being further arranged to transport the sheet to a temporary offline storage position, the apparatus being further arranged to transport the sheet back to the print position and to carry out a further servicing operation.

12. A printer apparatus arranged to print a print run comprising a series of images with one or more printheads and to implement a printhead servicing routine one or more times during the run, the routines comprising printing with said one or more printheads onto a selected sheet of print media and then transporting the sheet to an off-line position allowing the print run to proceed, the apparatus being further arranged to return the sheet to a print position to implement a further printhead servicing routine.

13. A method of servicing one or more printing elements of a printer during a print run, the printer having a sheet feed mechanism adapted to transport sheets to and from a print zone, comprising the steps of:

feeding a sheet of print media to the print zone;

implementing a servicing routine including generating one or more marks on the sheet with the one or more printing elements;

feeding the sheet to an off-line holding location;

feeding the sheet back to the print zone; and, carrying out a further servicing routine.

14. A method according to claim 13, further comprising, whilst the sheet is in the off-line holding location, the steps of:

feeding one or more further sheets of print media into the print zone;

printing at least part of a print job on the one or more further sheets; and, feeding the printed further sheets of print media to an output position.

15. A method according to claim 14, further comprising the step of:

printing a print run on a first type of print media, and generating marks during the servicing routine on a second type of print media.

16. A method according to claim 13, further comprising the steps of:

determining a period between each servicing routine for a printing element in dependence upon, the time since it was last used, the time since it last underwent a servicing routine or the throughput of the printer, the servicing history of the element, or a combination of these factors.

17. A method according to claim 13, wherein for each servicing routine marks generated on the sheet are generated on a substantially different part of the sheet.

18. A method according to claim 13, wherein the sheet is reused in a predetermined number of servicing routines or until it is determined that the sheet is consumed, for example, substantially covered in marks or substantially saturated with the printing substance used to mark the sheet.

19. A method according to claim 13, further comprising the step of:

feeding the sheet to a disposal position after it has been used in a predetermined number of servicing routines, or when it is determined to be consumed, the disposal position is different from the output position for a print job.

20. A method according to claim 13, wherein the printer is an inkjet printer.

21. A method according to claim 20, wherein the servicing routine comprises a spitting operation or printing a test print pattern using the one or more printing elements.

22. A method according to claim 13, further comprising the steps of:

scanning the marks generated on the sheet in a servicing routine with a scanner device.

23. A computer program comprising program code means for performing the method steps of claim 13 when the program is run on a computer and/or other processing means associated with suitable hardware.

24. A method of servicing an ink ejection nozzle of an inkiet printer, during printing a print run comprising a plurality of sequential print media sheets, the method comprising the steps of:

during the print run ejecting ink from the nozzle onto a selected print media sheet as part of a servicing routine;

holding the selected sheet in an off-line location whilst printing one or more further sheets of the print run; and, reintroducing the selected sheet into the print run when a further servicing routine is required and, repeating the step ejecting on the selected sheet.

25. A computer program comprising program code means for performing the method steps of claim 24 when the program is run on a computer and/or other processing means associated with suitable hardware.

26. A printer apparatus comprising one or more printing elements arranged to print on print media located in a print position, the apparatus further comprising first and second media paths respectively adapted to feed media to and away from the print position, the apparatus being arranged to selectively feed a print media sheet from the second media path to the print position via the first media path, the apparatus being arranged to implement a servicing routine comprising marking the selectively fed print media sheet with one or more of the printing elements.

27. A printer according to claim 26, further comprising a picking device arranged to pick a cut sheet of print media from a second media supply and to pass the picked sheet to the first media path, the printer being arranged to implement a servicing routine on the sheet before the sheet reaches the second media path.

28. A printer according to claim 27, comprising one or more picking devices arranged to pick cut sheets of print media from a first and the second media supply, the printer being adapted to select a sheet from the first supply for printing a print job and to select a sheet from the second supply for implementing a servicing routine.

29. A printer according to claim 26, further comprising a sheet diverter arranged to feed the print media sheet from the second media path to a third media path, the third media path being arranged to feed the print media sheet either directly to the print position or indirectly, via the first media path.

30. A printer according to claim 29, arranged to carry out a two or more servicing routines on a selected sheet, and further arranged to transport the selected sheet along the third media path between successive servicing routines.

31. A printer according to claim 26, further comprising a first and a second output position, and being arranged to output print jobs to the first position and to output sheets marked in servicing routines to the second position.

32. A printer according to claim 26, further comprising a scanner device, such as a charge coupled device (CCD), arranged to scan the marks made on a sheet upon which a servicing routine is performed.

33. A printer according to claim 26, wherein the printer is an inkjet printer.

34. A printer according to claim 33, wherein the servicing routine comprises a spitting operation or the printing of a drop detection pattern or a colour calibration pattern.

35. A printer according to claim 26, wherein the one or more printing elements form at least part of a page wide array.

* * * * *